United States Patent [19]

Davies et al.

[11] 4,067,436

[45] Jan. 10, 1978

[54] APPARATUS FOR CONVEYING ARTICLES

[75] Inventors: Robert William Davies; Leonard Thornton, both of London, England

[73] Assignee: Molins Limited, London, England

[21] Appl. No.: 741,431

[22] Filed: Nov. 12, 1976

[51] Int. Cl.[2] ..... B65G 25/00

[52] U.S. Cl. ..... 198/742; 198/487; 198/571; 198/718; 198/856; 271/269

[58] Field of Search ..... 198/487, 742, 746, 718, 198/689, 571, 468, 856; 271/136, 183, 269, 271, 229, 231

[56] References Cited

U.S. PATENT DOCUMENTS

| | | | |
|---|---|---|---|
| 2,919,789 | 1/1960 | Coakley | 271/183 X |
| 3,279,790 | 10/1966 | Steinke et al. | 271/136 |
| 3,301,374 | 1/1967 | Proctor | 198/742 |
| 3,369,807 | 2/1968 | Whelan | 271/269 |
| 3,498,441 | 3/1970 | Furedy et al. | 198/746 X |
| 3,512,629 | 5/1970 | Torrance | 198/718 |
| 3,829,085 | 8/1974 | Jeschke et al. | 271/231 |
| 3,888,344 | 6/1975 | Major | 198/746 X |

*Primary Examiner*—Bruce H. Stoner, Jr.
*Assistant Examiner*—James L. Rowland
*Attorney, Agent, or Firm*—John C. Smith, Jr.

[57] ABSTRACT

Packet blanks are fed stepwise along an elongated blank bed by a succession of pawls reciprocating along the length of the bed. Mechanism is provided for lifting the pawls at the end of their working strokes, and for lowering them at the end of their return strokes. In the event that the blank feed is to be interrupted, the mechanism can keep the pawls lifted without stopping reciprocating movement of the pawls.

5 Claims, 7 Drawing Figures

APPARATUS FOR CONVEYING ARTICLES

This invention concerns improvements in or relating to apparatus for conveying articles, such as packet blanks into which cigarettes are to be packed.

In U.S. Pat. No. 3,977,157 issued Aug. 31, 1976 to Davies et al to which reference is made in its entirety, there is disclosed a cigarette packing machine including apparatus for conveying packet blanks one at a time towards further apparatus in which a group of cigarettes is packed into each blank. The blanks are conveyed one step at a time by a reciprocating mechanism while certain pre-folding operations are carried out on the blank. Occasionally it happens that a group of cigarettes fails to arrive at said further apparatus together with the corresponding blank. For example, this may occur during starting up of the machine, or if a faulty group of cigarettes is rejected. In consequence the corresponding blank is formed into an empty packet, resulting in wastage of blanks and the need subsequently to reject the empty packet; more seriously, however, the empty packet may become jammed in the machine resulting in possible damage to the machine.

The present invention sets out to avoid such disadvantageous occurrences without the need to bring the reciprocating mechanism to a standstill.

According to the present invention there is provided apparatus for conveying articles such as packet blanks comprising a flat elongated surface along which in use articles are conveyed while certain operations are performed thereon, feed means selectively operable to feed a succession of articles on to one end of the surface, a member mounted adjacent the surface for reciprocation therealong, article engaging means carried by the member at regular intervals along the surface, and actuating means for actuating the article engaging means in timed relation with reciprocation of the member, whereby articles are successively engaged by the article engaging means during a forward stroke of the member and conveyed in steps away from said one end of the surface, said actuating means including control means operable to maintain the article engaging means disengaged, so that when operation of the feed means has been interrupted the conveying of articles along the surface is interruptible during continued reciprocation of the member.

The article engaging means may comprise pawls which are pivotable to extend and retract from the reciprocating member to engage with or disengage from the articles. The actuating means may comprise a driven cam, and a clutch which is disengageable or re-engageable during a return stroke of the reciprocating member.

For a fuller understanding of the invention a preferred embodiment thereof will now be described, by way of example, with reference to the accompanying drawings in which.

The apparatus shown in FIG. 1 is in parts similar to that disclosed with reference to FIGS. 3 to 10 of the above-mentioned U.S. Pat. No. 3,977,157. Such similar parts will therefore only be briefly described below, as reference may be had to said Patent for details thereof.

Figure 7:
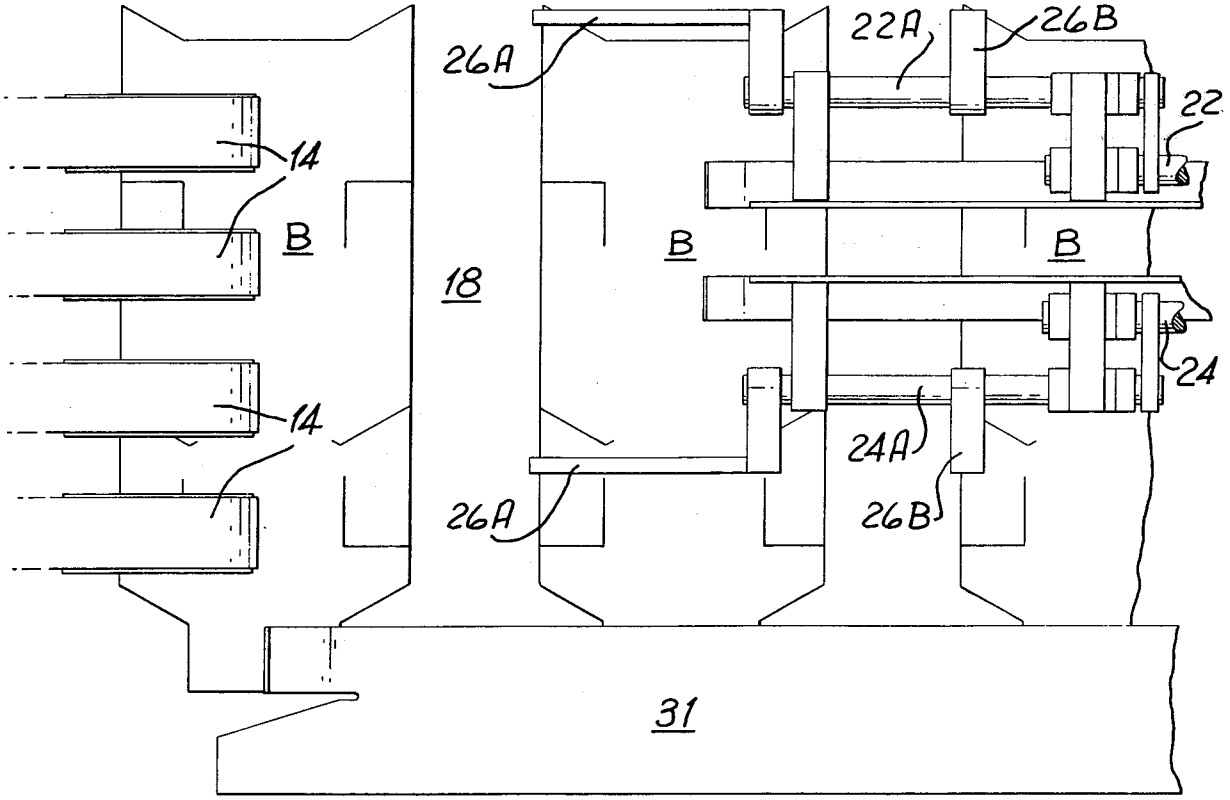
FIG. 7 is a plan view of part of the apparatus of FIG. 6 in the direction of arrow VII.

A stack of blanks is held in a hopper 10 from which the blanks B are removed one at a time by a suction pad 12 connected by a valve 13 to a source of suction (not shown). Above the suction pad are pairs of opposed conveyors 14 and 16 (see also FIG. 7) whose outlet is located at the left-hand lower end of a slightly inclined blank bed 18. The suction pad 12 is mounted on a mechanism which enables the pad, after having picked up a blank B, to be moved to the left and then upwards (as viewed in FIG. 1) so that the blank enters the nip between the conveyors 14, 16 as suction is released from the pad. The blank thus travels up the conveyors to be deposited substantially horizontally at the lefthand end of the bed 18.

A frame 20 (see also FIG. 4) is spaced from the bed 18 and is mounted for reciprocation along the bed by a mechanism to be described.

Figure 4:
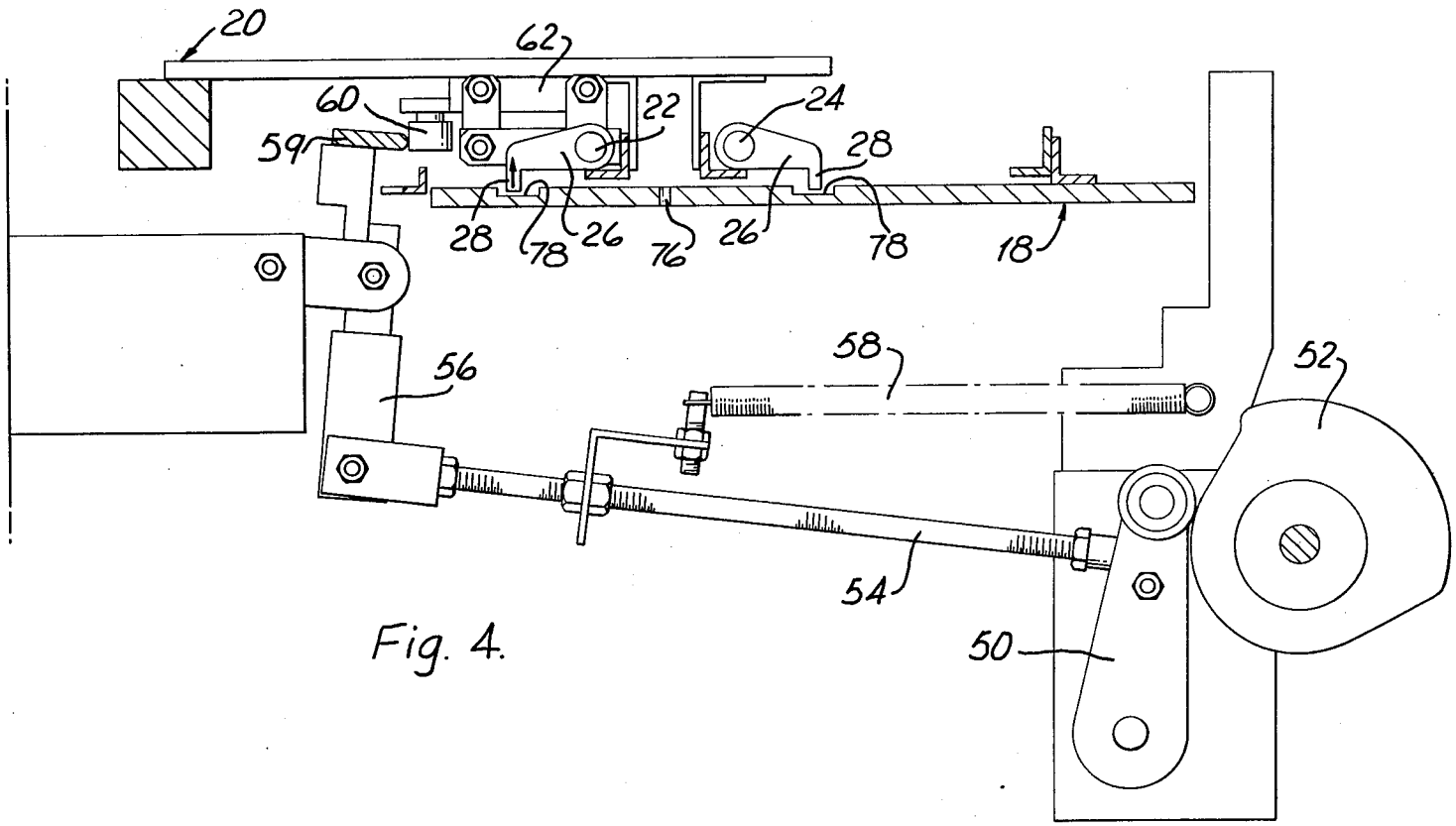
FIG. 4 is a section on the line IV—IV of FIG. 3.

The frame 20 carries a pair of shafts 22 and 24 to which pawls 26 are secured at regular inrtervals, each pawl 26 on shaft 22 being in alignment with a corresponding pawl 26 on shaft 24, and the pawls on the two shafts facing away from one another. The shafts are rotatable in opposite senses, (by mechanism which will be described below) to lift the pawls away from the bed 18, as best seen in FIG. 4. The free ends of the pawls are formed as claws 28 so that in their lowered position they engage the rear edges of the blanks. During reciprocating movement of the frame to the right, as viewed in FIG. 1, each blank B on the bed has its rear edges engaged by a pair of pawls, which thus convey the blank towards the right, while for the return movement of the frame to the left, the pawls are lifted until they can be lowered behind the rear edges of the next blank. In this way the blanks are conveyed in steps by successive pairs of pawls to a packet forming wheel 29 (which forms no part of the present invention), in preparation for bundles of cigarettes to be packed therein. During the feed of blanks along the bed, portions of each blank are folded over by a device indicated at 31 in FIG. 7, and adhesive is applied to various portions of the blank, as described in the above-mentioned application.

Figure 1:
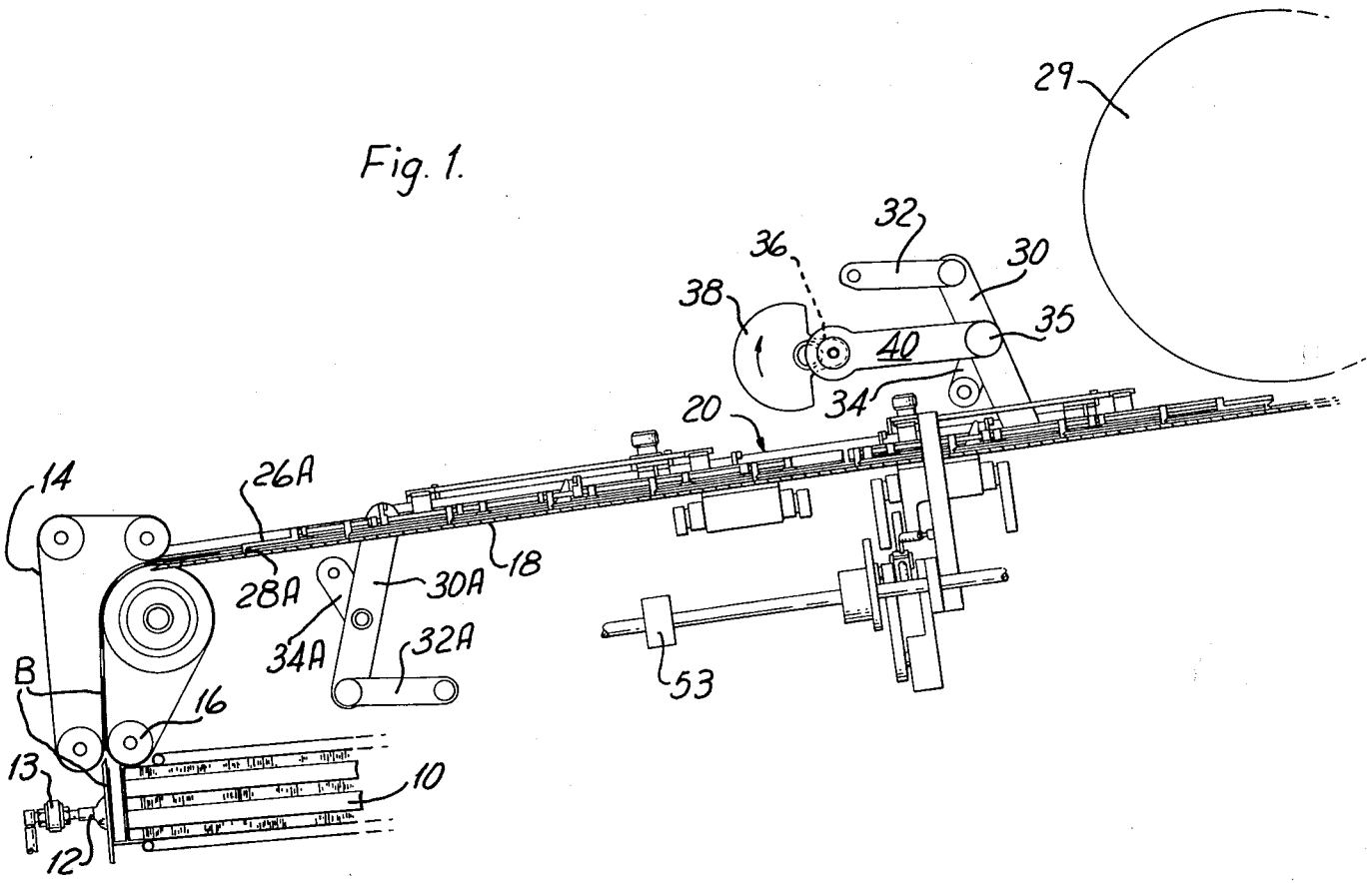
FIG. 1 is a side view, partly in section, of conveying apparatus according to the invention.
Figure 2:
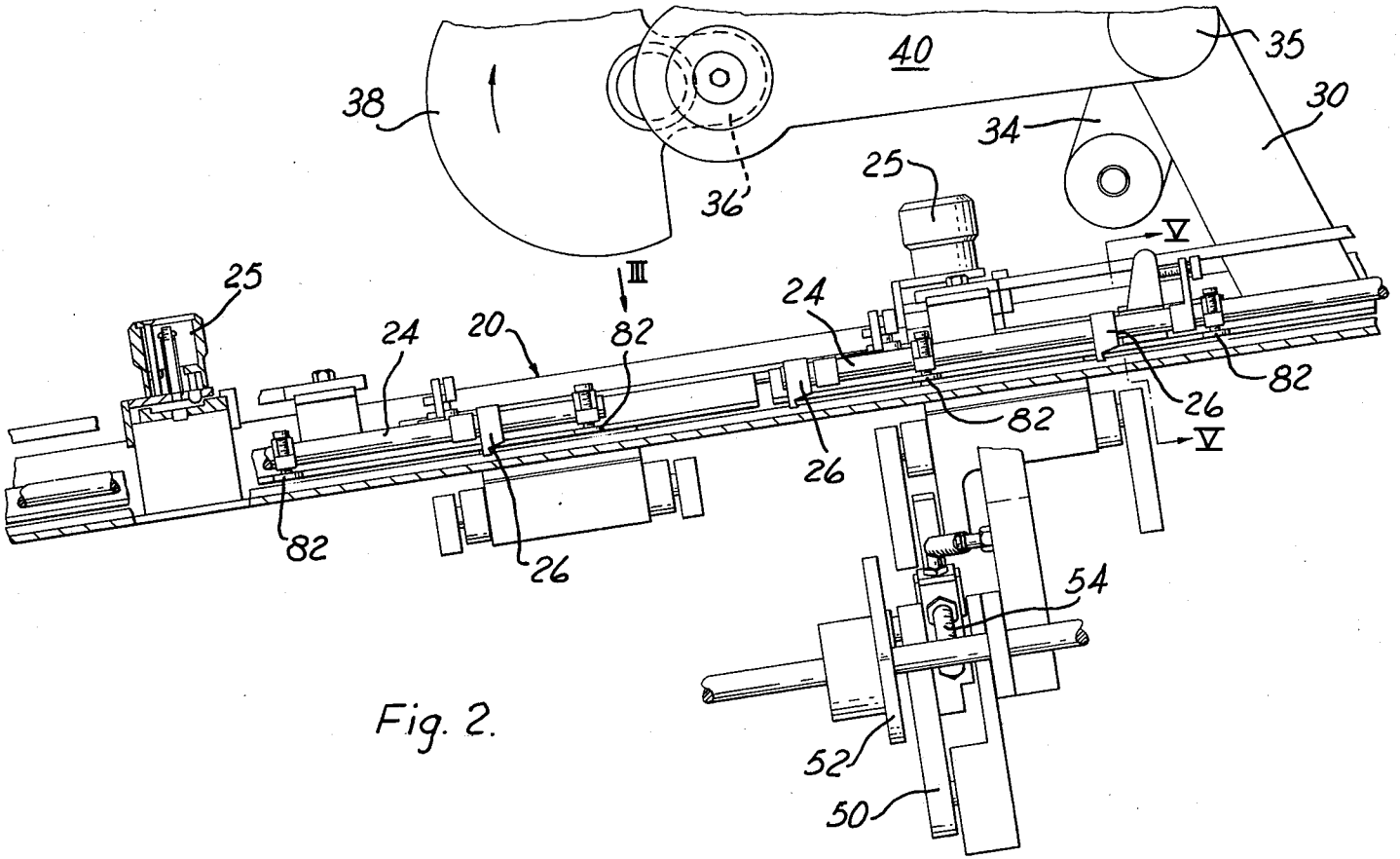
FIG. 2 is a detail view of the right hand part of the apparatus of FIG. 1, but drawn to a larger scale.
Figure 3:
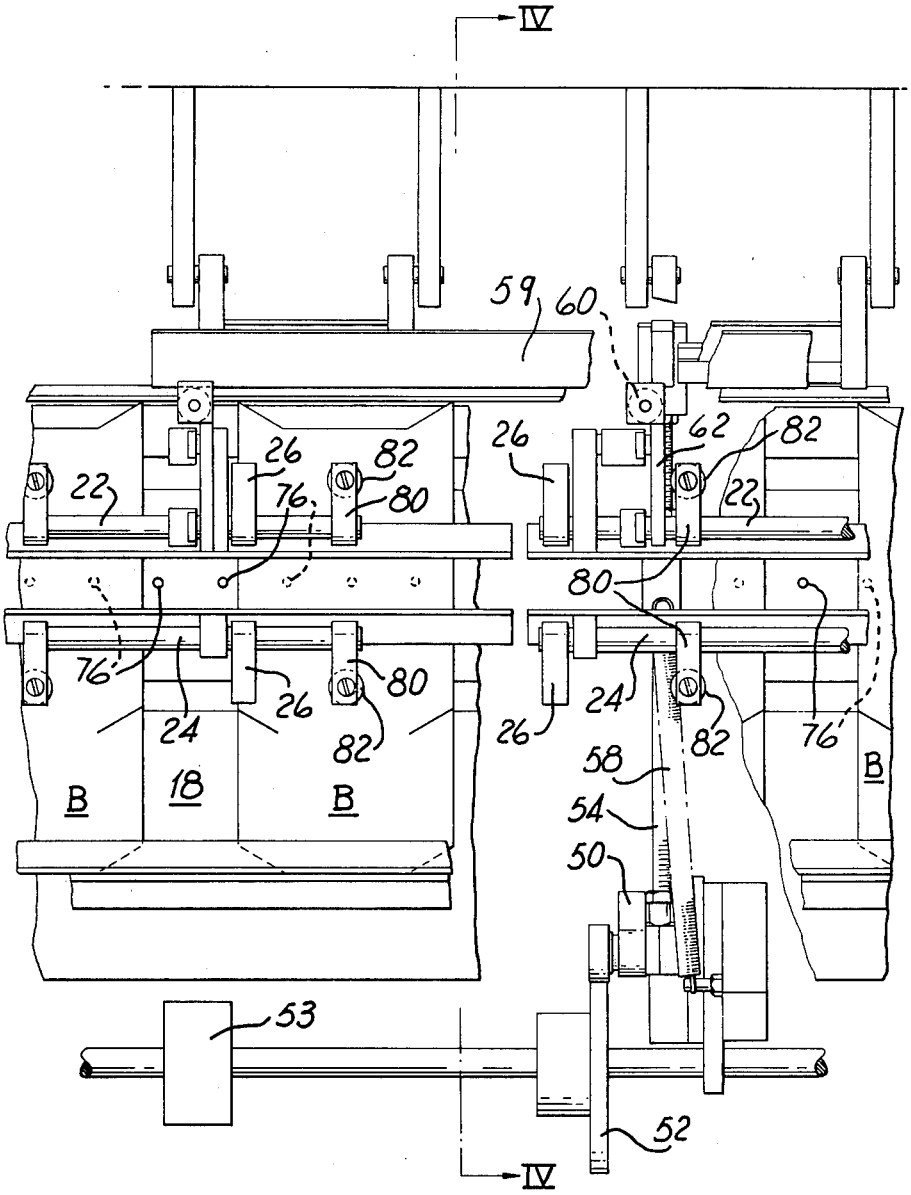
FIG. 3 is a plan view of the apparatus of FIG. 2 in the direction of arrow III, with certain parts omitted for the sake of clarity.

The mechanism for reciprocating the frame 20 is shown in FIGS. 1 and 2. The frame is pivotally mounted towards its right-hand end to one end of a long member 30 whose other end is pivotally connected to a short member 32, which in turn is pivoted to fixed structure (not shown). A further short member 34 is pivotally connected to the long member 30 at an axis 35 about mid-way between its ends. The end of the member 34 remote from the long member 30 is also pivoted to fixed structure (not shown).

The left-hand end of the frame 20 is supported by slave members 30A, 32A and 34A which are similar to the members 30, 32 and 34 respectively, except that they are located for convenience beneath and to the rear of the bed 18 as viewed in FIG. 1.

Reciprocating movement is imparted to the member 30 by a driven crank 36 having a counter-weight 38, a connecting rod 40 being provided between the crank 36 and the axis of rotation 35 of the member 30. Reciprocation of the member 30 between the position shown and the position to the left thereof results in the lower end of the member 30, and hence the frame 20, moving along a substantially straight line parallel to the bed 18.

The mechanism for operating the pawls 26 will now be described with particular reference to FIGS. 3 to 6.

A cam follower 50 is actuated by a cam 52, which is driven through a clutch 53 (FIG. 1) in timed relation with the drive to the crank 36. The clutch is arranged to be disengageable or re-engageable during the return stroke of the frame 20, as further described below. The cam follower operates through a rod 54 on a substantially vertical lever 56 which is pivoted near its center to fixed structure. A tension spring 58 connected to the rod 54 biasses the follower 50 into engagement with the cam 52. The upper end of the lever 56 carries a rail 59 which engages a plurality of roller 60. Each roller is connected by a parallelogram linkage 62 to the shaft 22.

It should here be pointed out that there are not continuous shafts 22 and 24 extending along the whole bed 18: as can be seen from FIG. 2 the shafts are formed in two sections which can be individually removed from the frame 20 by quick-release devices 25 in order to gain access to the bed 18. It will also be seen from FIG. 7 that the first pair of pawls (identified by reference 26A) are elongated laterally to enable their claws 28A (FIG. 1) to extend between the separate belts of the conveyors 14 and 16; and the second pair of pawls (reference 26B), as also the first pawls 26A, are mounted on shafts 22A and 24A which are spaced apart further than the shafts 22 and 24. However, for the sake of simplification, the apparatus will be described as if all the pairs of pawls were the same, and as if there were only a single continuous pair of shafts 22 and 24.

As the cam follower 50 is moved to the left (FIG. 4) during the part of the cam cycle at which the follower encounters the ascending portions of the cam, the lever 56 is pivoted clockwise, and moves the roller 60 and linkage 62 to the right, causing the shaft 22 to rotate clockwise (FIG. 4). The shaft 24 is at the same time caused to rotate anti-clockwise and all the pawls 26 are thus lifted clear of the blanks B.

Figure 5:
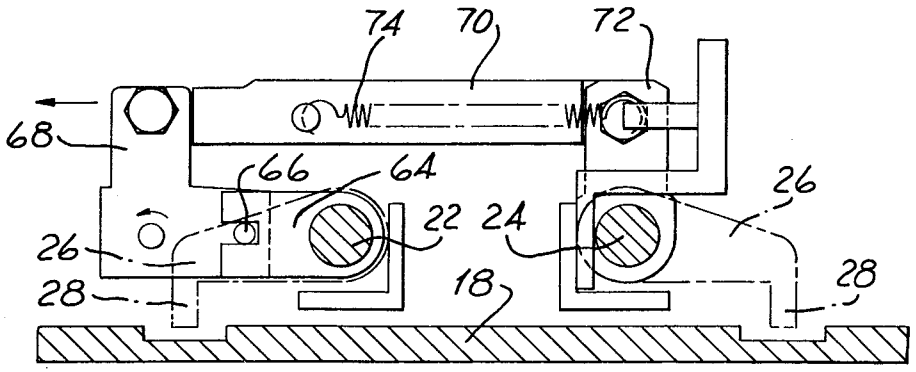
FIG. 5 is a section on the line V—V of FIG. 2.
Figure 6:
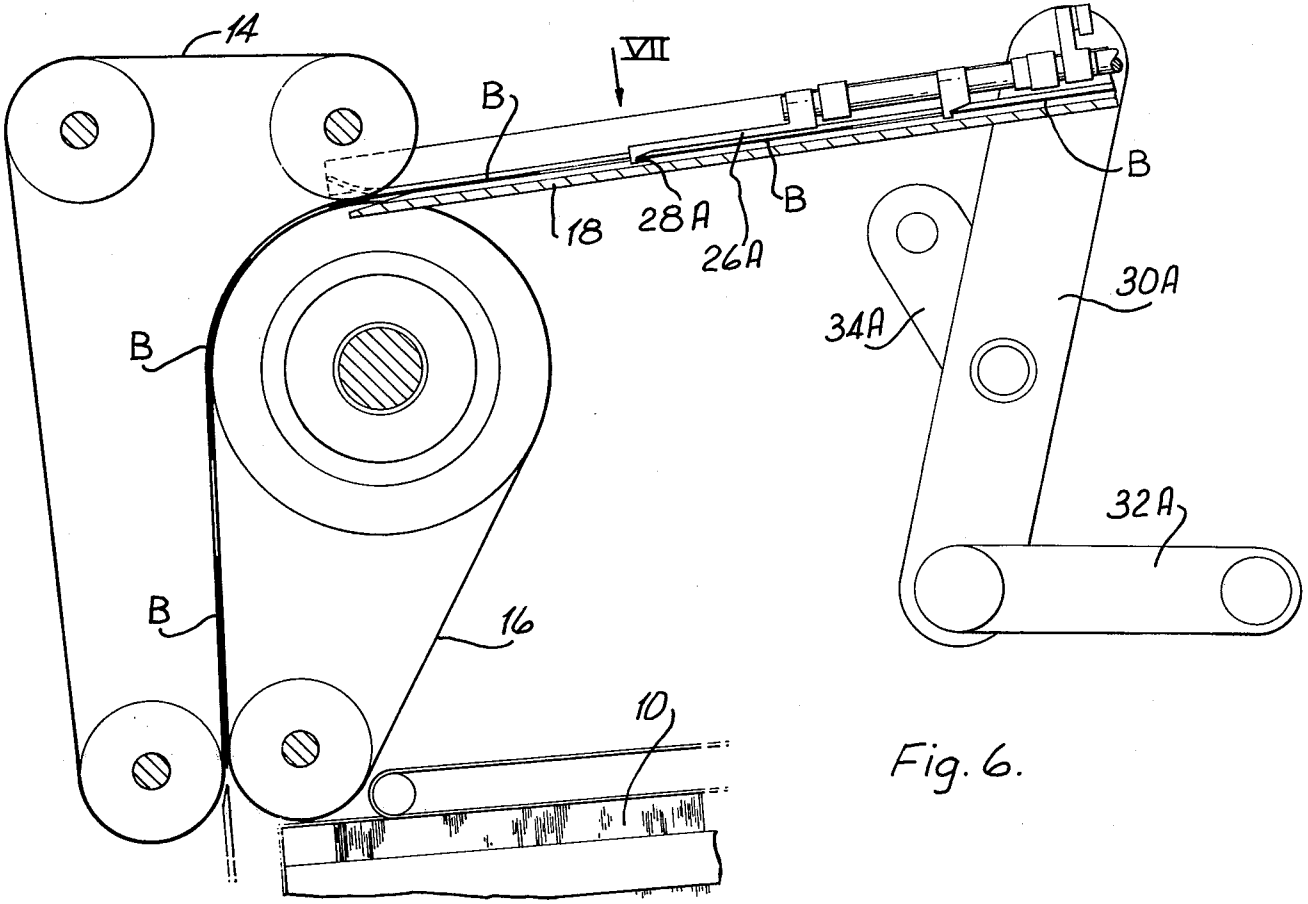
FIG. 6 is a detail of the left-hand part of FIG. 1, but drawn to a larger scale.

The rotation of shaft 24 is derived from shaft 22 through a linkage shown in FIG. 5. A forked arm 64 secured to the shaft 22 engages a pin 66 at one end of an L-shaped lever 68. The other end of the lever 68 is connected by a link 70 to an arm 72 secured to the shaft 24. Thus clockwise rotation of the shaft 22 produces anti-clockwise rotation of the lever 68, which causes the link 70 to be pulled to the left, so that the arm 72 and shaft 24 rotate anti-clockwise. A tension spring 74 is connected to the link 70 to urge the latter to the right, thus biassing shafts 22 and 24 clockwise and anti-clockwise respectively, so that when the cam follower 50 reaches the descending portion of the cam 52 the pawls 26 are returned to the lowered position in which they are shown.

Longitudinal grooves 78 (FIG. 4) are formed in the bed 18 beneath the claws 28 of pawls 26 to provide clearance for the claws 28 during their working strokes.

Along the center of the bed 18 are a number of holes 76 (FIGS. 3 and 4) which are connected to a source of suction (not shown). The resultant suction on the blanks B ensures that they are firmly held against the bed, particularly during the return strokes of the pawls 26, when the blanks are stationary.

Fixed to the shafts 22 and 24 ahead of each pawl 26, as considered in the direction of conveyance of the blanks, are arms 80 (FIG. 3), which thus move up and down together with the pawls. On each arm 80 is adjustably mounted a friction pad 82. The pad 82 are so adjusted, relative to the shafts 22 and 24, that while the pawls are at a lowered position, the pads apply a light downward pressure on the blanks B. In operation, when a blank is conveyed by a pair of pawls 26 and the reciprocating mechanism is decelerating at the end of its stroke, the respective pair of pads 82 assists the suction applied to the blank through the holes 76, and prevents any overshoot of the blank beyond the position at which the pawls have come to rest.

During normal operation of the apparatus (i.e. so long as blanks are required to be fed to the packet wheel 29) the pawls 26 are raised and lowered at opposite ends of the reciprocation of the frame 20, as above described. However if a blank is not required at the wheel 29, for example if there is a temporary delay in the supply of bundles of cigarettes to be packed, a signal is transmitted to the valve 13 to shut off suction to the pad 12 during the return stroke of the pad, preventing it from picking up further blanks. After a timed delay of sufficient duration to allow the one or two blanks already in the conveyors 14 and 16 to be fed to the bed 18, the clutch 53 is disengaged during the return stroke of the frame, i.e. during the part of the cam cycle in which the pawls 26 are raised: the operation of the clutch 53 and the valve 13 may be controlled by any suitable known logic circuit. The frame 20 now continues to reciprocate, but with the pawls disengaged so that the blanks are no longer conveyed stepwise towards the wheel 29.

When the supply of cigarette bundles is resumed, the valve 13 is re-opened during the return stroke of the pad 12. After a delay sufficient for blanks to be fed into the conveyors 14 and 16, the clutch 53 is also re-engaged, at the correct timing relative to reciprocation of the frame 20, so that a continuous feed of blanks is again obtained.

We claim:

1. Apparatus for conveying articles such as packet blanks comprising a flat elongated surface along which in use articles are conveyed while certain operations are performed thereon, feed means selectively operable to feed a succession of articles on to one end of the surface, a member mounted adjacent the surface for reciprocation therealong, article engaging means carried by the member at regular intervals along the surface, and actuating means for actuating the article engaging means in timed relation with reciprocation of the member, whereby articles are successively engaged by the article engaging means during a forward stroke of the member and conveyed in steps away from said one end of the surface, said actuating means including control means operable to maintain the article engaging means disengaged, said control means comprising a driven member to actuate said article engaging means and coupling means through which the drive to said driven member passes and which is disengageable and reengageable during a return stroke of said reciprocating member, so that when operation of the feed means has been interrupted the conveying of articles along the surface is interruptible during continued reciprocation of the member.

2. Apparatus for conveying articles such as packet blanks comprising a flat elongated surface along which in use articles are conveyed while certain operations are performed thereon, feed means selectively operable to feed a succession of articles on to one end of the surface, a member mounted adjacent the surface for reciprocation therealong, article engaging means carried by the member at regular intervals along the surface, and actuating means for actuating the article engaging means in timed relation with reciprocation of the member, whereby articles are successively engaged by the article engaging means during a forward stroke of the member and conveyed in steps away from said one end of the surface, said actuating means including control means operable to maintain the article engaging means disengaged, said control means comprising a driven cam to actuate the article engaging means and a clutch through which the drive to the cam passes and which is disengageable and reengageable during a return stroke of the reciprocating member, so that when operation of the feed means has been interrupted the conveying of articles along the surface is interruptible during continued reciprocation of the member.

3. Apparatus as claimed in claim 1 in which the article engaging means comprises pawls which are pivotable to extend and retract from the reciprocating member to engage with or disengage from the articles.

4. Apparatus as claimed in claim 3 in which the pawls are arranged in pairs, the two pawls in each pair being pivotable in opposite senses.

5. Apparatus as claimed in claim 1 in which said elongated surface is provided with suction holes, so that the articles are held to the surface by suction.

* * * * *

UNITED STATES PATENT OFFICE

CERTIFICATE OF CORRECTION

Patent No. 4,067,436 Dated January 10, 1978

Inventor(s) Robert William Davies and Leonard Thornton

It is certified that error appears in the above-identified patent and that said Letters Patent are hereby corrected as shown below:

On the title page, column 1, between lines 8 and 9 should read:

-- Foreign Application Priority Data

November 18, 1975 Great Britain.....47397/75 --

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*